US005524612A

United States Patent [19]

Chen

[11] Patent Number: 5,524,612

[45] Date of Patent: Jun. 11, 1996

[54] DRINKING DEVICE FOR DIVERS

[76] Inventor: Jiunn-Liang Chen, 7 Fl., No. 85, Likung Rd., Taiping Hsiang, Taichung Hsien, Taiwan

[21] Appl. No.: 343,190

[22] Filed: Nov. 22, 1994

[51] Int. Cl.[6] ..... B63C 9/00

[52] U.S. Cl. ..... 128/202.15; 128/200.29; 128/201.11

[58] Field of Search ..... 128/202.13, 202.15, 128/202.16, 202.27, 205.18, 201.26, 201.27, 201.28, 912, 204.24, 201.11, 200.29

[56] References Cited

U.S. PATENT DOCUMENTS

| | | | |
|---|---|---|---|
| 4,398,533 | 8/1983 | Barker | 128/202.15 |
| 4,815,893 | 3/1989 | Feder . | |
| 5,389,024 | 2/1995 | Chen | 128/202.15 |

FOREIGN PATENT DOCUMENTS 0175813 4/1986 European Pat. Off. .

OTHER PUBLICATIONS

*Patent Abstracts of Japan,* abstract of Japanese Patent No. JP 5-092796 dated Apr. 16, 1993; vol. 17, No. 430, Aug. 10, 1993.

*Primary Examiner* Edgar S. Burr
*Assistant Examiner* V. Srivastava
*Attorney, Agent, or Firm* Merchant, Gould, Smith, Edell, Welter & Schmidt

[57] ABSTRACT

A drinking device for divers includes a bag in which edible liquid is contained, a pipe, a cylinder and a pump, the pipe is connected between the bag and the cylinder via the pump, the cylinder is disposed to a mouthpiece received in a diver's mouth and has an inlet and an outlet defined therein and a piston movably engaged therein. A conduit is connected between the mouthpiece and the outlet of the cylinder such that the liquid contained in the bag is pushed into the diver's mouth via the pipe, the cylinder, the outlet and the conduit by operating the piston. A wire connected between the pump and the mouthpiece has an operation button disposed to a distal end thereof received in the mouthpiece such that the liquid is pumped into the diver's mouth by biting of the button by the diver.

3 Claims, 5 Drawing Sheets

DRINKING DEVICE FOR DIVERS

BACKGROUND OF THE INVENTION

The present invention relates to a drinking device and, more particularly, to a drinking device which is operated by hands of divers while underwater.

In scuba diving, a diver has air tanks worn on his/her back in order to breathe underwater, however, the air received in the air tanks lacks humidity to prevent corrosion occurring in the tanks, therefore, the diver feels dryness of his/her throat and lungs. A drinking device is developed in the art such as U.S. Pat. No. 4,398,533 which has a mouthpiece for the diver to suck water therefrom and is positioned by a clip to connect to a vest of the diver, the mouthpiece has an open end and is controlled by a valve such that the diver should first remove his/her regulator from his/her mouth and then insert the open end of the mouthpiece into his/her mouth and then operate the valve to an open position to let water in a bag to be sucked into the diver's mouth via the mouthpiece, but in this way, too many actions should be taken by the diver when he/she wants to drink. Furthermore, as the mouthpiece is secured by the clip to the vest of the diver, the clip could be disengaged from the vest by water flow and the valve also could be mis-operated by the water flow, both of these points being disadvantageous when the diver wants to hold the mouthpiece to suck water.

The present invention intends to provide a drinking device which includes a means for pumping water from a bag and the means is coupled to a mouthpiece and is operated by a hand of the diver so as to mitigate and/or obviate the above-mentioned problems.

SUMMARY OF THE INVENTION

The present invention provides a drinking device for divers, which includes a bag in which edible liquid contained, a pipe, a cylinder and a pump, the pipe is connected between the bag and the cylinder via the pump, the cylinder is disposed to a mouthpiece received in a diver's mouth and has and a piston movably engaged therein. A conduit is connected between the mouthpiece and the outlet of the cylinder such that the liquid contained in the bag is pushed into the diver's mouth via the pipe, the cylinder, the outlet and the conduit by operating the piston. A wire connected between the pump and the mouthpiece has an operation button disposed to a distal end thereof received in the mouthpiece such that the liquid is pumped into the diver's mouth by biting of the button by the diver.

It is an object of the present invention to provide a drinking device disposed directly to a mouthpiece and which is operated by a hand of the diver.

It is a further object of the present invention to provide a drinking device which occupies a small volume and permits the diver to turn his/her head freely.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
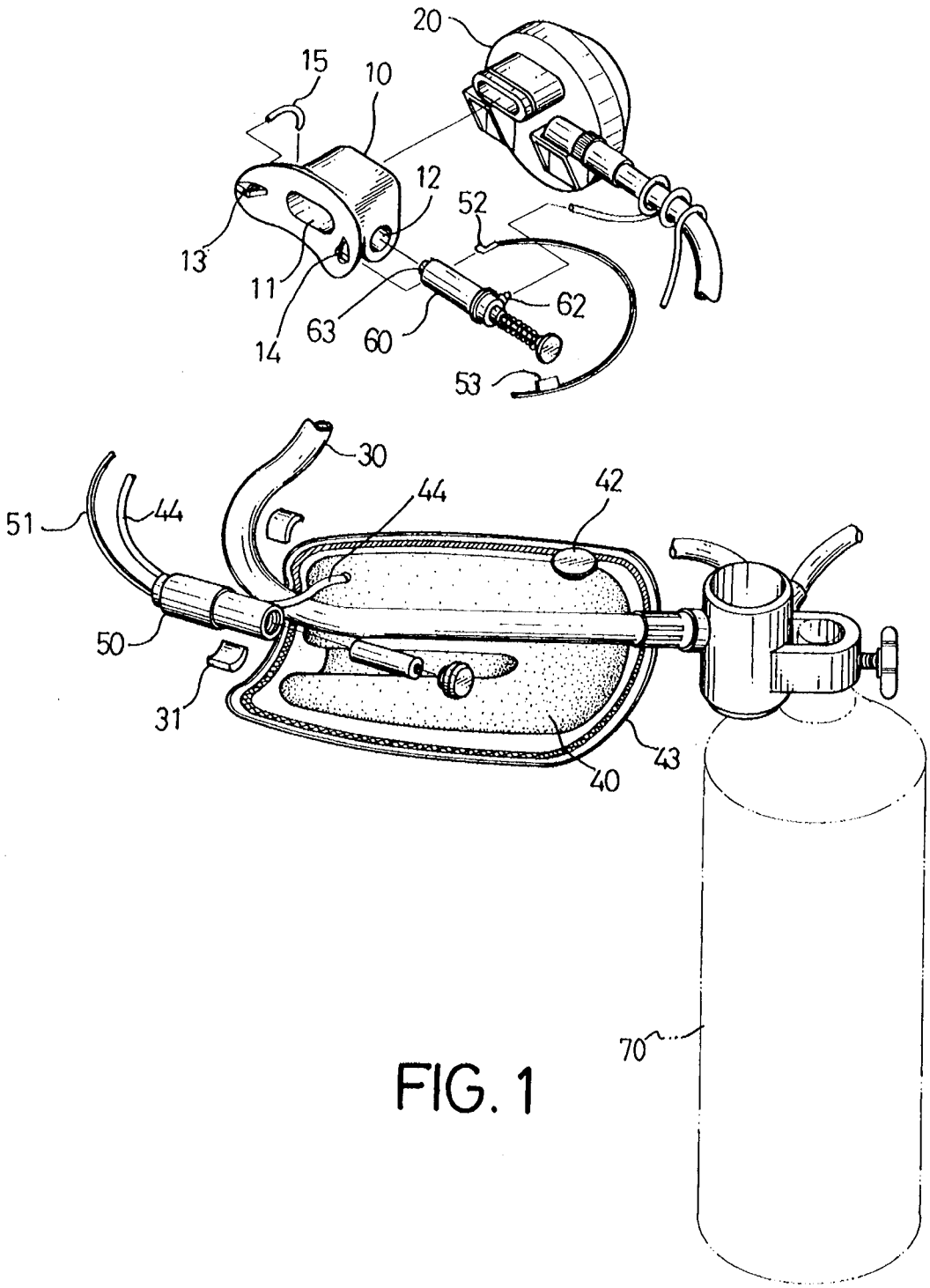
FIG. 1 is an exploded view of a drinking device in accordance with the present invention.
Figure 2:
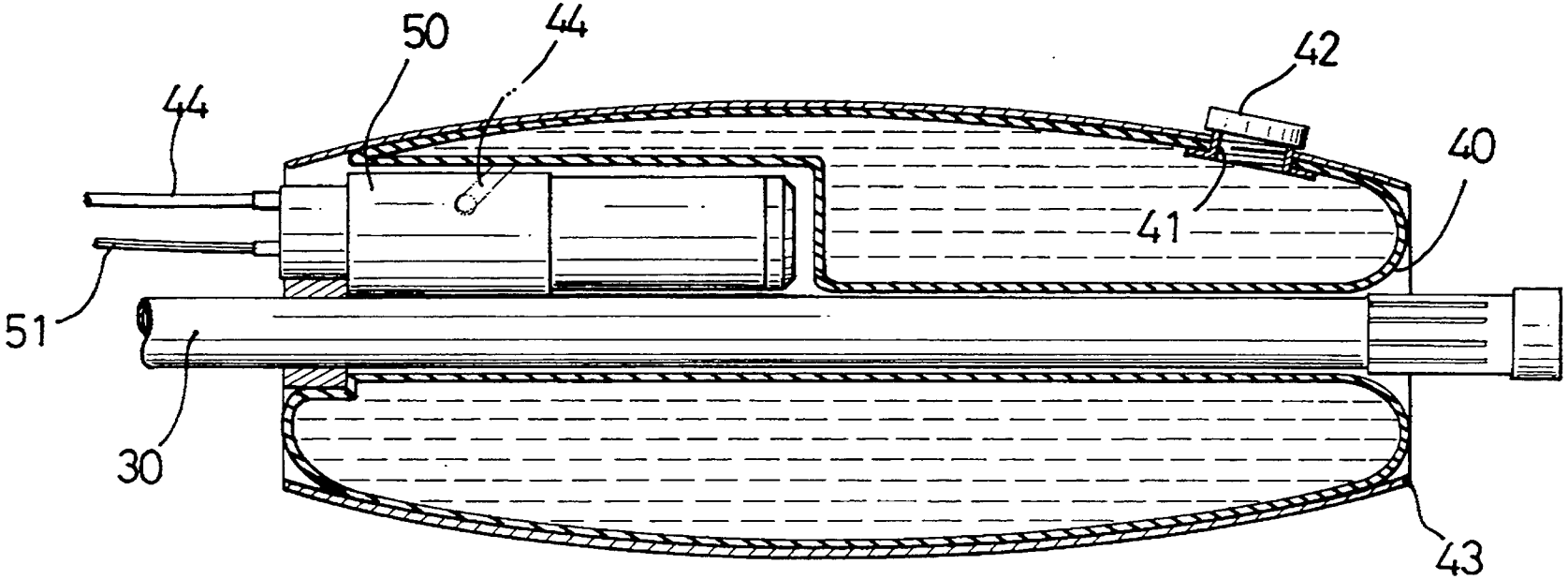
FIG. 2 is a side elevational view, partly in section, of a pump and a hose enclosed in a bag in accordance with the present invention.

Referring to the drawings and initially to FIGS. 1 and 2, a diving apparatus includes a mouthpiece 10 which is received in a diver's mouth, a regulator 20 and at least one air tank 70 which contains compressed air, a hose 30 is connected between the air tank 70 and the regulator 20 which is connected to the mouthpiece 10 such that the diver can breathe from the air tank 70. A drinking device in accordance with the present invention includes a bag 40, a pump 50 and a cylinder 60, the bag 40 is made of flexible material, preferably transparent, in which contains edible liquid, and an opening 41 is defined therein for permitting liquid to be inserted into the bag 40 and a cap 42 securely and sealedly covered the opening 41. The pump 50 and the hose 30 are enclosed by the flexible bag 40 and the bag 40 is securely enclosed by a coat 43. Two weights 31 are disposed to the hose 30 within the enclosed bag 40 in order to provide a better positioning feature. The bag 40 has a pipe 44 extending therefrom and is wound around the hose 30 to connect to the cylinder 60 via the pump, 50 such that liquid in the bag 40 can be pumped to the cylinder 60 by the pump 50, the pump 50 has a wire 51 extending therefrom, an operation button 52 and a switch 53 are disposed to the wire 51 wherein the operation button 52 is disposed to a distal end thereof.

Figure 3:
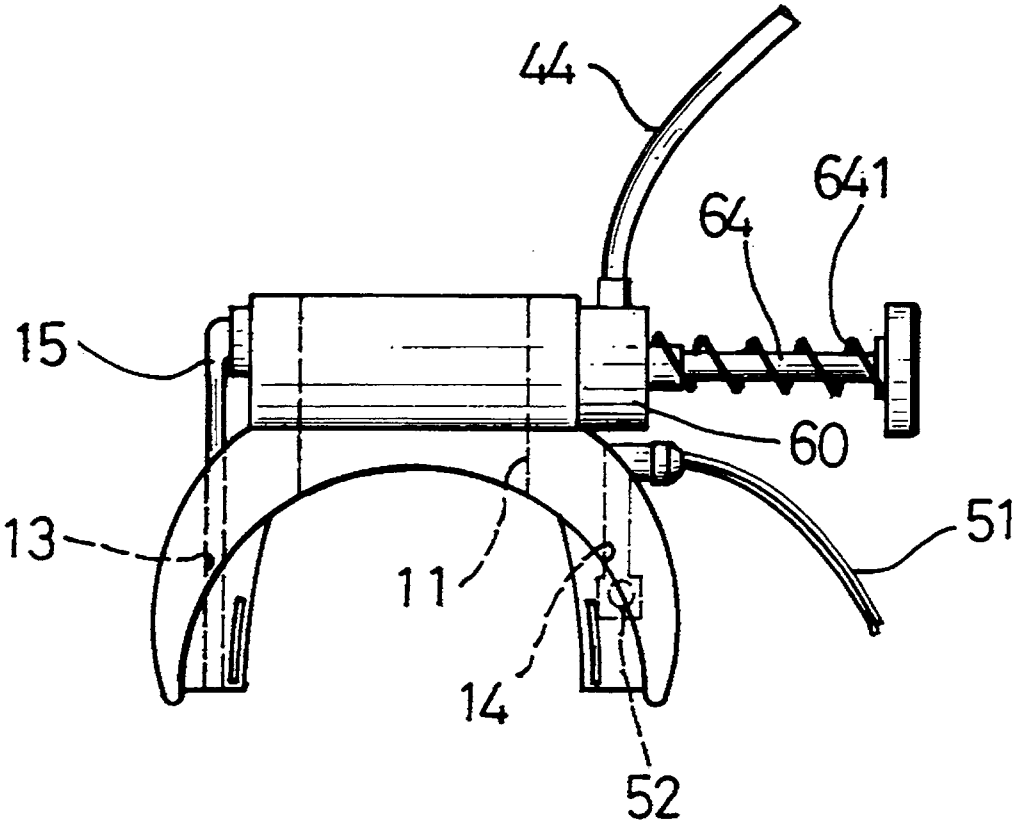
FIG. 3 is a side elevational view of a cylinder disposed to a mouthpiece and part of a conduit and an operation button received in the mouthpiece are shown in phantom lines.
Figure 4:
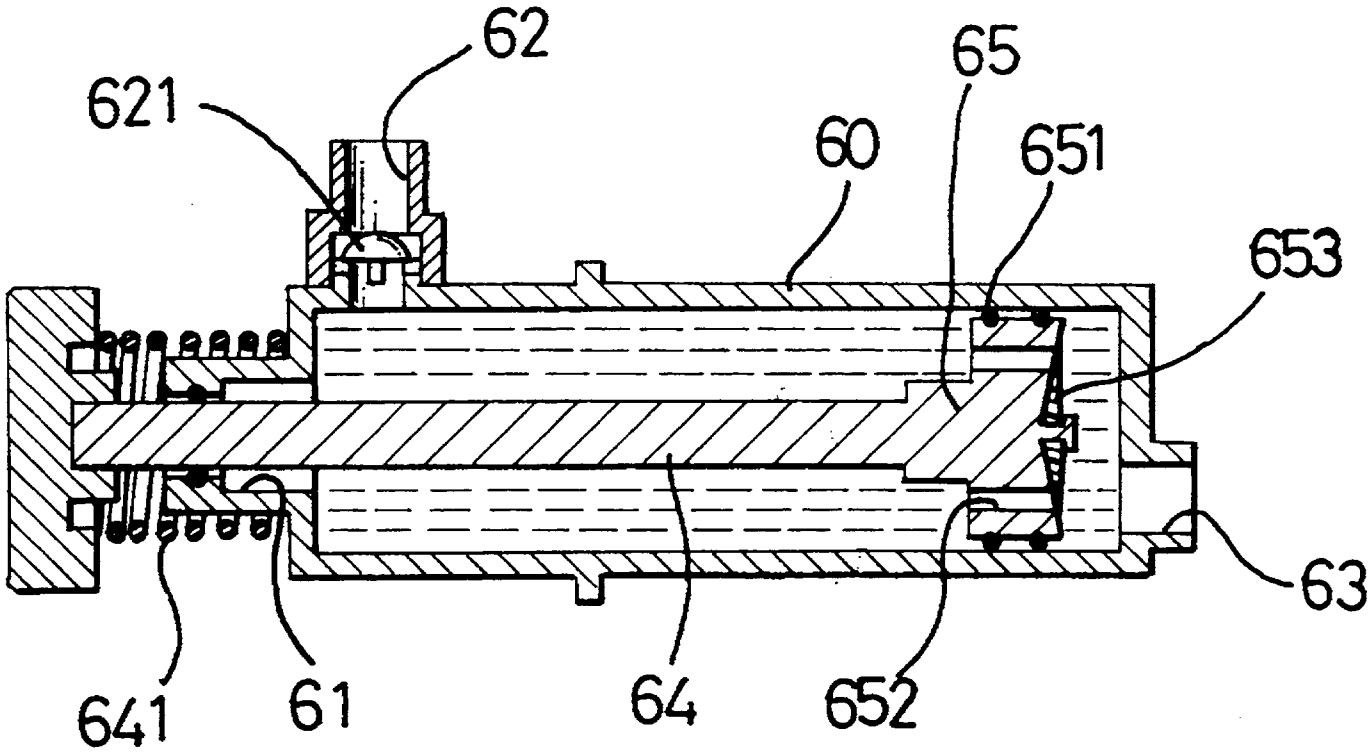
FIG. 4 is a side elevational view, in section, of the cylinder and a piston received therein which is pushed towards an outlet of the cylinder.
Figure 5:
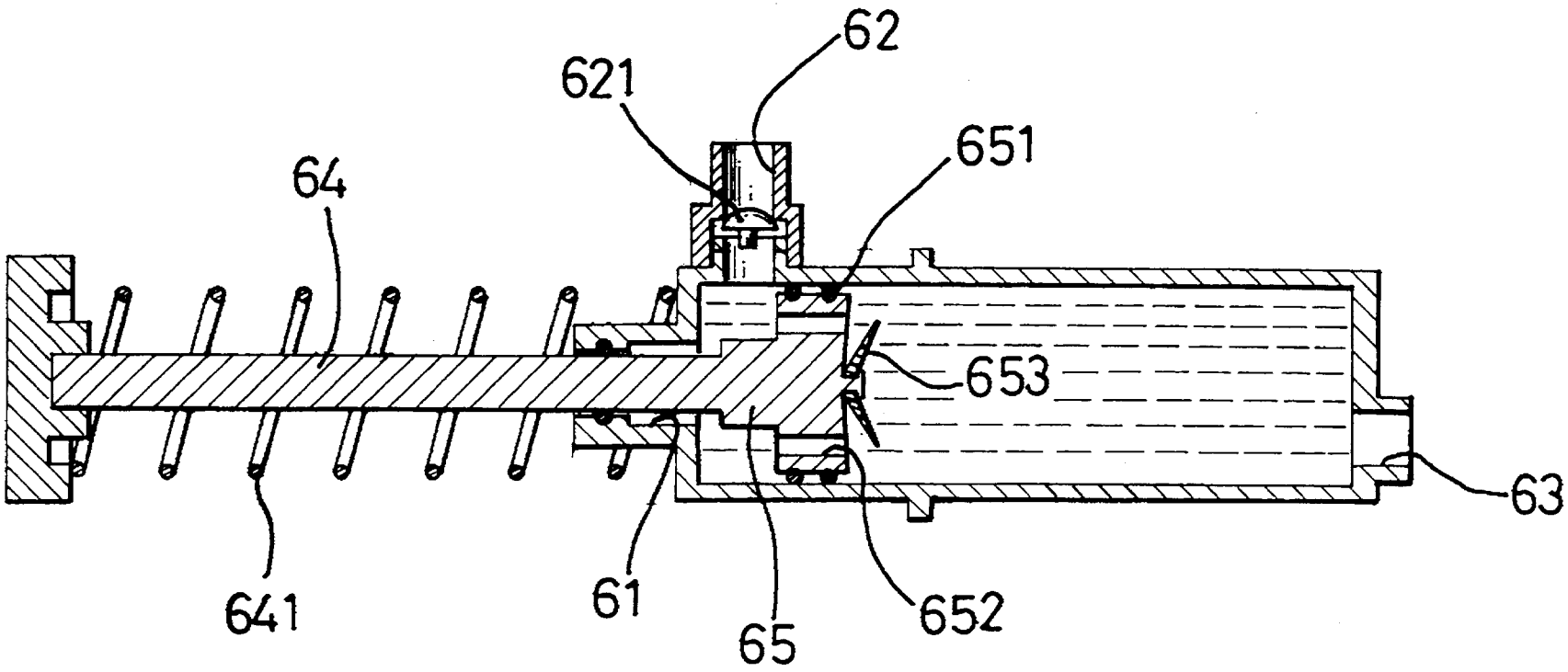
FIG. 5 is a side elevational view of the cylinder wherein the piston is positioned in an un-actuated position.

Referring now to FIGS. 1 and 3, the regulator 20 is connected to the mouthpiece 10 which has a central hole 11 longitudinally defined therein and communicated with the regulator 20, a first hole 12 transversely defined therein for said cylinder 60 inserted therethrough, a second hole 13 defined longitudinally therein communicated with the diver's mouth and a third hole 14 defined longitudinally in a side of the mouthpiece 10 opposite to thee second hole 13 and is also communicated with the diver's mouth. Referring to FIGS. 4 and 5, the cylinder 60 has an opening 61 defined in a first end thereof, an inlet 62 defined in a periphery thereof in which a check valve 621 is disposed and an outlet 63 defined in a second end thereof, a piston 64 is slidably engaged in the cylinder 60 via the pump 61 and has a piston head 65 formed in an end thereof within the cylinder 60, the piston head 65 has two seals 651 disposed to a periphery thereof so as to seal between an inner periphery of the cylinder 60 and the piston head 65 which has two passages 652 longitudinally defined therein and a flexible cover 653 is disposed to an end of the piston head 65 so as to cover the passages 652 thereby. A distal tip of the piston 64 extends outwardly from the opening 61 of the cylinder 60 and has an enlarged head so as to bias a resilient element 641 between the enlarged head and the cylinder 60.

Referring to FIGS. 1 and 5, the pipe 44 extending from the bag 40 is connected to the inlet 62 via the pump 50, a conduit 15 is connected between the outlet 63 of the cylinder 60 and the second hole 13, and the operation button 52 of the wire 51 is inserted through the third hole 14 of the mouthpiece 10 so as to be operated by teeth of the diver. Accordingly, the diver may turn the switch 53 of the pump 50 on and operate the operation button 52 by teeth, the liquid is then pumped by the pump 50 into the cylinder 60 via the pipe 44 and flows through the passages 652 of the piston head 65 and then flows into the diver's mouth via conduit 15. Referring to FIG. 4, if an electrical power source of the pump 50 has run out, the diver may push the piston 64 to push the liquid in a region between the outlet 63 and the piston head 65 into the conduit 15, during the pushing action, the liquid in the bag 40 is sucked into the cylinder 60 via the inlet 62 by a force from the lower pressure in the region between the opening 61 and the piston head 65.

The present invention provides a cylinder 60 disposed to the mouthpiece 10 so as to pump liquid from the bag 40 by a hand, this is advantageous especially when the electrical power source of the pump 50 has run out or is out of order, and the cylinder 60 occupies a small volume such that less resistance is produced when the diver turns his/her head.

Although the invention has been explained in relation to its preferred embodiment, it is to be understood that many other possible modifications and variations can be made without departing from the spirit and scope of the invention as hereinafter claimed.

I claim:

1. A drinking device for divers, comprising:

an air tank and a regulator attached thereto;

a bag in which edible liquid is received;

a mouthpiece having a central hole defined therein for engagement with said regulator, said mouthpiece having a first hole defined therein and a second hole defined therein communicating with a diver's mouth, a conduit having a first end inserted through said second hole and a second end;

a cylinder having an open end defined therein and a piston extending through said open end to a piston head in said cylinder, said cylinder having an inlet and an outlet defined therein, a resilient element disposed about the portion of the piston which extends out from said opening and engaging the outside of said cylinder, said cylinder being received in said first hole;

a pipe connected between said bag and said inlet of said cylinder, said inlet having a check valve disposed therein for preventing flow of said edible liquid back to said pipe from said cylinder, said second end of said conduit being connected to said outlet of said cylinder; and said piston head being movably engaged within said cylinder and having at least one hole longitudinally therethrough and a flexible cover disposed on said piston head to cover said hole such that when said piston is pushed to compress said resilient element liquid is delivered to a diver's mouth via said conduit.

2. The drinking device as claimed in claim 1, further comprises a pump to which said pipe is engaged, said mouthpiece having a third hole defined therein communicating with said diver's mouth and said pump having a wire extending therefrom so as to connect to said mouthpiece via said third hole defined in said mouthpiece, said wire having an operation button disposed to a distal end thereof and being operated by said diver's teeth.

3. The drinking device as claimed in claim 2 wherein said wire has a switch disposed thereto between said pump and said mouthpiece for actuating a power source of said pump.

* * * * *